US005613715A

United States Patent [19]

Kim

[11] Patent Number: 5,613,715

[45] Date of Patent: Mar. 25, 1997

[54] BACKSET ADJUSTING DEVICE OF CYLINDRICAL DOOR LOCK

[75] Inventor: Won-Sae Kim, Taegu, Rep. of Korea

[73] Assignee: Hyundai Metal Co., Ltd., Taegu, Rep. of Korea

[21] Appl. No.: 507,871

[22] Filed: Jul. 27, 1995

[51] Int. Cl.[6] ..... E05C 1/00

[52] U.S. Cl. ..... 292/1.5; 292/169.14; 292/337

[58] Field of Search ..... 292/1.5, 169.14, 292/337, DIG. 60, DIG. 61

[56] References Cited

U.S. PATENT DOCUMENTS

| | | | |
|---|---|---|---|
| 4,729,585 | 3/1988 | Lin | 393/337 |
| 4,729,586 | 3/1988 | Fang | 292/337 |
| 4,840,412 | 6/1989 | Shen | 292/337 |
| 4,840,413 | 6/1989 | Shen | 292/337 |
| 5,149,151 | 9/1992 | Shen | 292/DIG. 60 X |

*Primary Examiner*—Rodney M. Lindsey
*Assistant Examiner*—Monica E. Millner
*Attorney, Agent, or Firm*—Banner & Witcoff, Ltd.

[57] ABSTRACT

A backset adjusting device of a cylindrical door lock. This device free adjusts the backset of the door lock between the 60 mm backset and the 70 mm backset and lets the door lock be commonly used in the conventional doors regardless of the door types. A latch bolt extension slide coupled to a latch bolt has an axial guide slot. A retractor slide is coupled to the latch bolt extension slide so as to linearly reciprocate with respect to the extension slide by 10 mm. This retractor slide has an opened axial guide slit at its front section and a side guide projection movably received in the guide slot of the extension slide for guiding the axial reciprocation of the retractor slide with respect to the extension slide. A pair of hooking notches are formed on the rear section of the retractor slide. An outer cylinder is movably fitted over a rear section of an inner cylinder and coupled to the hooking notches of the retractor slide. This outer cylinder axially moves with respect to the inner cylinder while trailing the retractor slide, thus to adjust the backset of a dead bolt of the door lock between 60 mm backset and 70 mm backset.

3 Claims, 5 Drawing Sheets

BACKSET ADJUSTING DEVICE OF CYLINDRICAL DOOR LOCK

BACKGROUND OF THE INVENTION

1. Field of the Invention

The present invention relates in general to a cylindrical door lock and, more particularly, to an improved structure of such a cylindrical door lock for adjusting the backset of the lock in order to be commonly used in both 60 mm backset door and 70 mm backset door.

2. Description of the Prior Art

As well known to those skilled in the art, conventional cylindrical door locks are generally classified into two types, that is, 60 mm backset door locks and 70 mm backset door locks, in accordance with their backsets. Here, the term "backset" means the horizontal distance from the face of a latch bolt to a knob center or a keyhole of a cylindrical door lock. In order to correspond to the commercialized door locks having the above different backsets, the doors which are to be equipped with the door locks should have the different distances from their free edges to the centers of their cylinder knob receiving holes. In this regard, a door should be equipped with a specified cylindrical door lock having a corresponding backset. Otherwise stated, a door of which the distance from its free edge to the center of its knob receiving hole corresponds to the 60 mm backset should be equipped with a 60 mm backset door lock while a door of which the distance from its free edge to the center of its knob receiving hole corresponds to the 70 mm backset should be equipped with a 70 mm backset door lock.

Since the conventional cylindrical door locks are separately produced and commercialized in the 60 mm backset type locks and 70 mm backset type locks, the conventional door locks have a problem in that they, while giving no problem to those skilled in the art, often cause confusion of users who want to change themselves their door locks but have no information about the backsets of the door locks to be changed.

That is, a user who wants to change himself his door lock but has no information about the backset of his door lock will certainly buy a new door lock without confirmation of the backset of the door lock dead bolt. When the backset of the new door lock fortunately fits the door, there will be no problem in installation of the door lock in the door. However, when the backset of the new door lock does not fit the door, the user should call on the lock seller in order to exchange the door lock. This makes the user confused and troubled.

SUMMARY OF THE INVENTION

It is, therefore, an object of the present invention to provide a backset adjusting device of a cylindrical door lock in which the aforementioned problem can be overcome and which simply adjusts the backset of the door lock between 60 mm and 70 mm and lets the door lock be commonly used in the conventional doors regardless of the door types.

In order to accomplish the above object, a backset adjusting device of a cylindrical door lock in accordance with an embodiment of the present invention comprises a latch bolt, the bolt having an enlarged cavity at its rear center; a latch bolt extension slide received in the cavity of the latch bolt at its front section and coupled to the latch bolt by a fixing pin, the extension slide having an axial guide slot; a retractor slide received in the cavity of the latch bolt at its front section in parallel with the latch bolt extension slide and movably coupled to the latch bolt extension slide so as to linearly reciprocate with respect to the extension slide by 10 mm, the retractor slide having: an opened axial guide slit, the guide slit being formed on a front section of the retractor slide and receiving the fixing pin therein; a side guide projection extending from a side surface of a middle section of the retractor slide toward the extension slide, the side guide projection being movably received in the guide slot of the extension slide in order to slide in the guide slot and to guide axial reciprocation of the retractor slide with respect to the extension slide; and a pair of hooking notches formed a rear section of the retractor slide; an inner cylinder axially receiving both the extension slide and the retractor slide such that rear sections of the slides protrude out of a rear end of the inner cylinder; and an outer cylinder movably fitted over a rear section of the inner cylinder and coupled to the hooking notches of the retractor slide at its rear end, the outer cylinder axially moving with respect to the inner cylinder while trailing the retractor slide, thus to adjust the backset of a dead bolt of the door lock between 60 mm backset and 70 mm backset.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
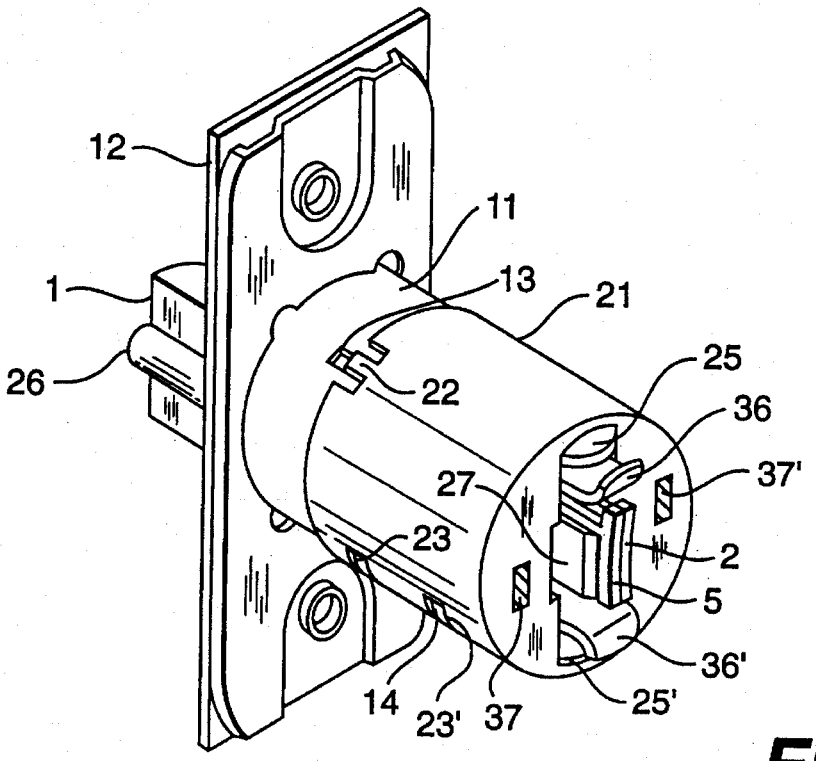
FIG. 1 is a perspective view of a dead bolt assembly of a cylindrical door lock having a backset adjusting device in accordance with a preferred embodiment of the present invention, when adjusted to the 60 mm backset.
Figure 2:
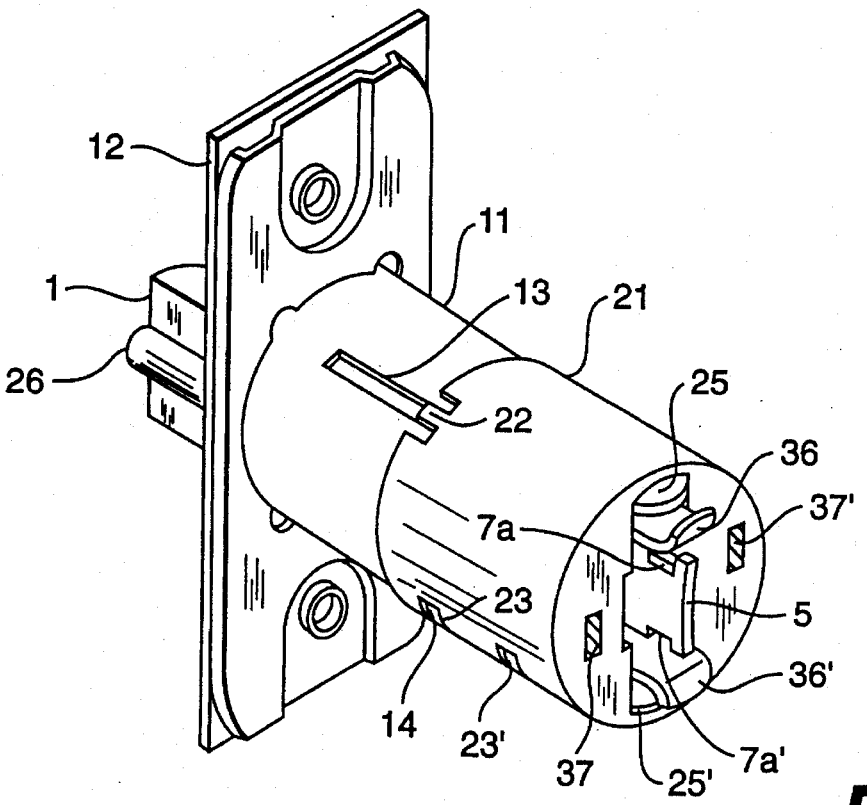
FIG. 2 is a view corresponding to FIG. 1, but showing a state adjusted to the 70 mm backset.

With reference to FIGS. 1 and 2, there is shown in perspective views a cylindrical door lock dead bolt assembly having a backset adjusting device in accordance with a preferred embodiment of the present invention. The dead bolt assembly shown in FIG. 1 is adjusted to the 60 mm backset while the dead bolt assembly shown in FIG. 2 is adjusted to the 70 mm backset. The dead bolt assembly 50 adjusted to the 60 mm backset will be used in a door of which the distance from its free edge to the center of its cylinder knob receiving hole corresponds to the 60 mm backset. Meanwhile, the dead bolt assembly 50 adjusted to the 70 mm backset will be used in a door of which the distance from its free edge to the center of its cylinder knob receiving hole corresponds to the 70 mm backset.

Figure 3:
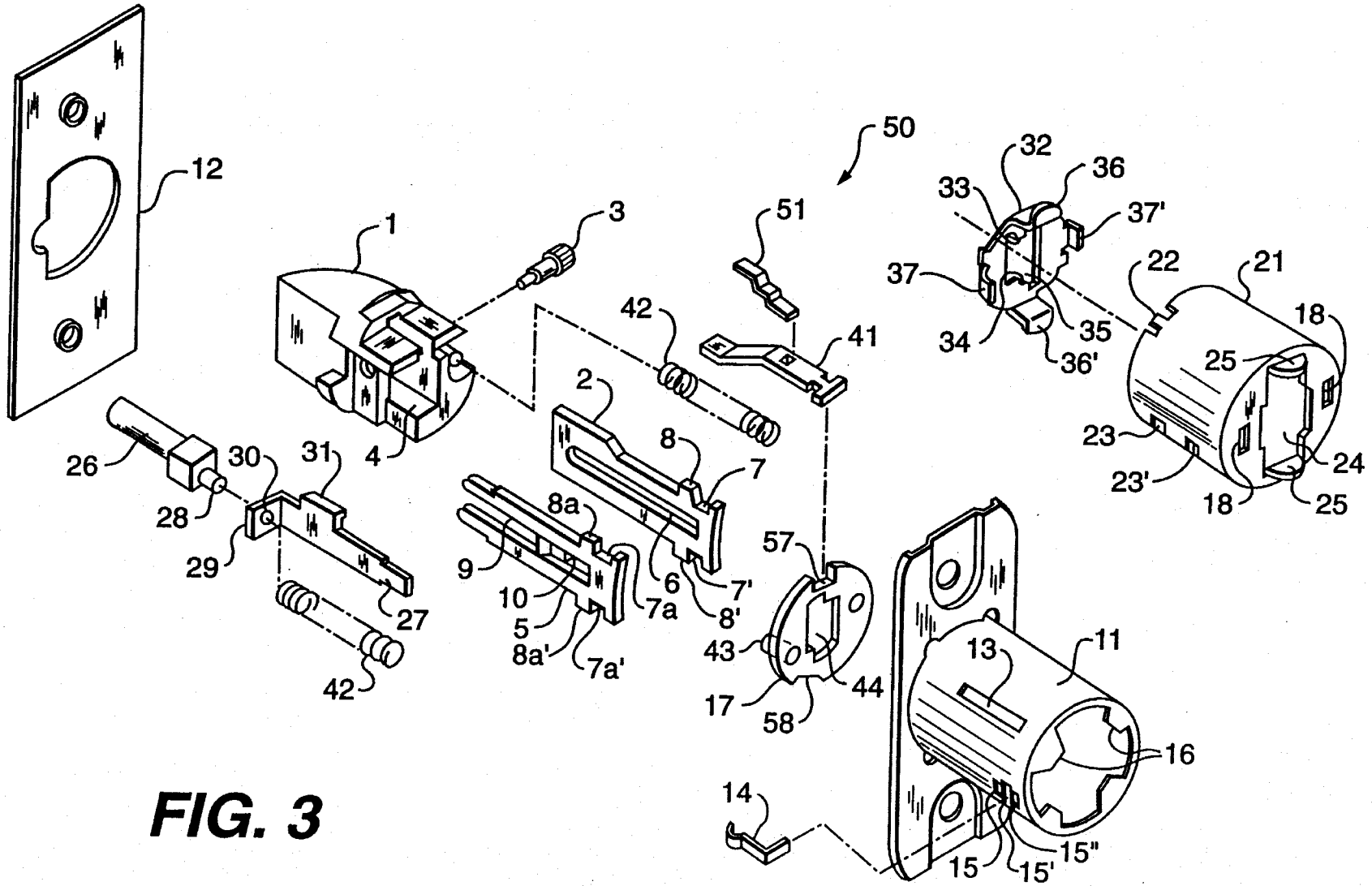
FIG. 3 is an exploded perspective view of the dead bolt assembly of FIG. 1.

The structure of the dead bolt assembly 50 is best seen in FIG. 3 which is an exploded perspective view of the dead bolt assembly 50. As shown in FIG. 3, the dead bolt assembly 50 includes a latch bolt 1 which receives a latch bolt extension slide 2 at its rear section. In order to receive the extension slide 2, the rear section of the latch bolt 1 is provided with an axial cavity 4. The extension slide 2 received in the cavity 4 is coupled to the rear section of the latch bolt 1 by a latch bolt fixing pin 3. The axial cavity 4 formed in the rear section of the latch bolt 1 is enlarged in its size in order to additionally receive a retractor slide 5. In the conventional manner, the extension slide 2 has an elongated guide slot 6 at its center. This slide 2 also has both a pair of hooking protrusions 7 and 7' and a pair of stop protrusions 8 and 8' at its rear section. The protrusions 7, 7', 8 and 8' of the slide 2 define a pair of hooking notches therebetween. The retractor slide 5 is axially slitted from its front end to its middle section, thus to form an elongated guide slit 9 which is opened at its front end. The retractor slide 5 also has a side guide projection 10 at its middle section where the guide slit 9 is ended. The side guide projection 10 extends outward from a side surface of the middle section of the retractor slide 5. In the same manner as described for the latch bolt extension slide 2, the rear section of the retractor slide 5 is provided with both a pair of hooking protrusions 7*a* and 7*a'* and a pair of stop protrusions 8*a* and 8*a'*. When the retractor slide 5 is received in the cavity 4 of the latch bolt 1 along with the extension slide 2, the retractor slide 5 can axially move with respect to the extension slide 2. The extension slide 2 is coupled to the latch bolt 1 by the pin 3 which is laterally inserted in the latch bolt 1. The pin 3 also passes through the guide slit 9 of the retractor slide 5. In this case, the side guide projection 10 of the retractor slide 5 is movably received in the elongated guide slot 6 of the extension slide 2, so that the guide projection 10 slides in the guide slot 6 when the retractor slide 5 axially reciprocates with respect to the pin 3 so as to adjust the backset.

Figure 4:
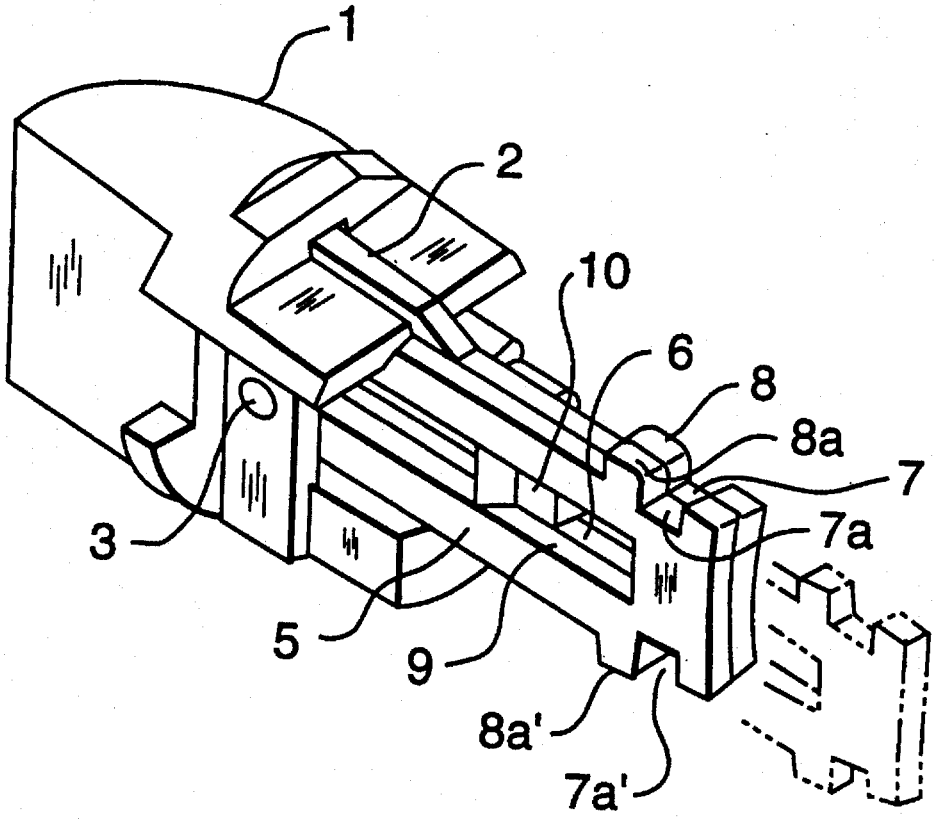
FIG. 4 is an enlarged perspective view showing an operation of a dead bolt of the present invention.

When assembling the extension slide 2, the retractor slide 5 and the latch bolt 1 into a dead bolt shown in FIG. 4, both the extension slide 2 and the retractor slide 5 are received in the cavity 4 of the latch bolt 1. At this time, the extension slide 2 is coupled to the bolt 1 by the pin 3 while the retractor slide 5 is movably coupled to the extension slide 2 by slide engagement of the side guide projection 10 of the retractor slide 5 to the guide slot 6 of the extension slide 2.

The dead bolt of FIG. 4 is axially received in an inner cylinder 11 which is fixed to a mounting panel 12 at its front end. An axial guide hole 13 is axially formed on the side wall of the cylinder 11. The inner cylinder 11 also includes an inside hole 15, a seating recess 15' and an outside insert hole 15" which are formed in a line on the side wall of the cylinder 11 at a position backward spaced apart from the guide hole 13 at an angular interval of 45°. The inside hole 15, the seating recess 15' and the outside insert hole 15" receive an elastic lock piece 14 which is formed by bending of a plate spring.

An outer cylinder 21 is movably fitted over the rear section of the inner cylinder 11. This outer cylinder 21 includes a bent insert 22 at its front end. The bent insert 22 is downward bent and inserted into the guide hole 13 of the inner cylinder 11 when the outer cylinder 21 is fitted over the rear section of the inner cylinder 11. The outer cylinder 21 also has a pair of rectangular holes 23 and 23' which are formed on the side wall of the outer cylinder 21 at positions backward spaced apart from the bent insert 22 at angular intervals of 45°–90°. The rectangular holes 23 and 23' are axially spaced apart from each other at 10 mm interval. When coupling the inner cylinder 11 to the outer cylinder 21, the elastic lock piece 14 of the inner cylinder 11 is elastically received in one of the rectangular holes 23 and 23' of the outer cylinder 21. The outer cylinder 21 has a rectangular opening 24 at its rear end for allowing the rear sections of both the extension slide 2 and the retractor slide 5 to pass therethrough as shown in FIG. 1. A pair of rounded projections 25 and 25' extend backward from the end surface of the outer cylinder 21 at the upper and lower edges of the rectangular opening 24 respectively. A pair of elongated rectangular holes 18 and 18' are vertically formed on the end surface of the outer cylinder 21 at opposed sides of the rectangular opening 24 respectively.

Figure 6:
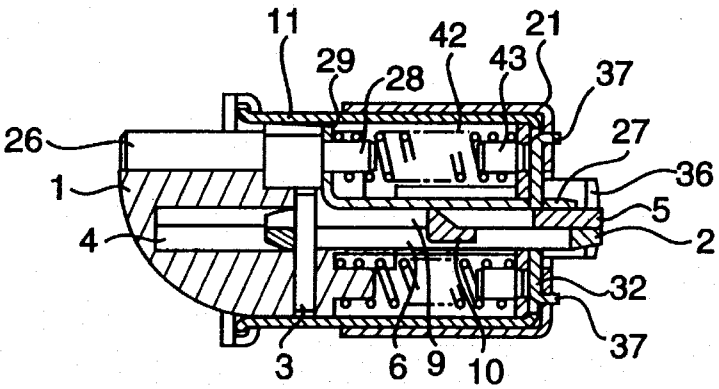
FIG. 6 is a sectional view of the dead bolt assembly taken along the section line A—A' of FIG. 5.
Figure 7:
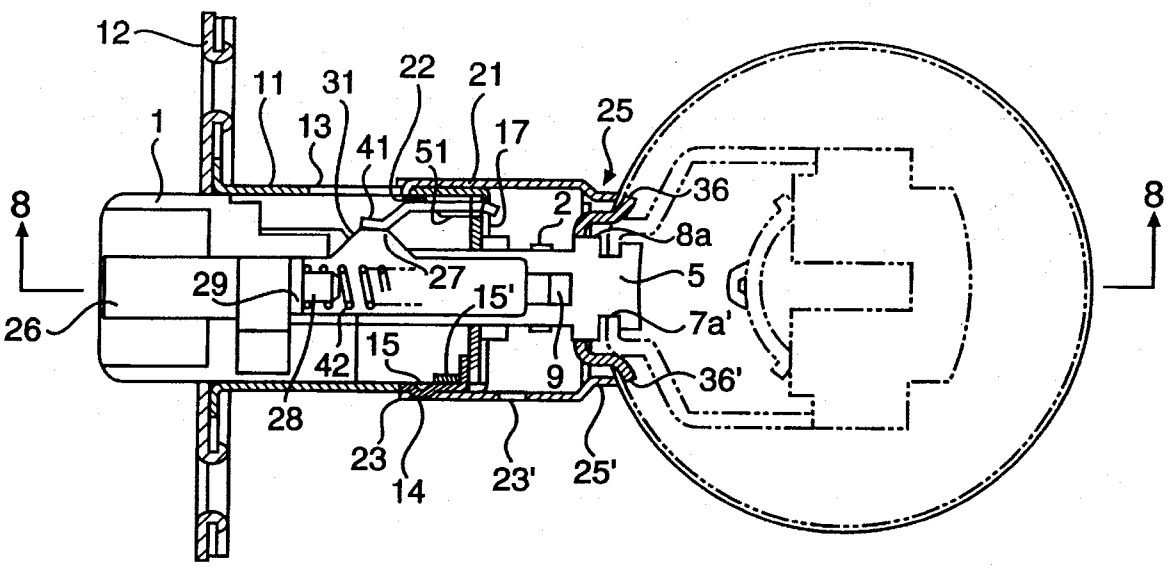
FIG. 7 is a sectional view of the cylindrical door lock having the backset adjusting device of this invention, when used as a 70 mm backset door lock.
Figure 8:
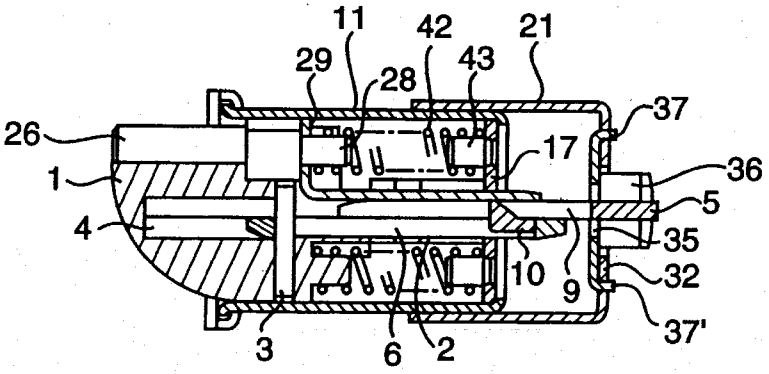
FIG. 8 is a sectional view of the dead bolt assembly taken along the section line B—B' of FIG. 7.

A latch guard bolt 26 having a semicircular section extends in parallel with the latch bolt 1 while closely contacting with the flat surface of the latch bolt 1. A projection rod 28 extends from the rear end of the latch guard bolt 26 for coupling a guard bolt extension slide 27 thereto. The guard bolt extension slide 27 is bent at right angle at its front section, thus to form a contact portion 29. This contact portion 29 has a through hole 30 receiving the projection rod 28 of the latch guard bolt 26. A biasing protrusion 31 extends upward from a upper middle section of the guard bolt extension slide 27. The biasing protrusion 31 is in turn bent outward at right angle for retaining a stable position of a latch bolt stopping plate 41 which is adapted for stopping the latch bolt 1. The guard bolt extension slide 27 not only supports the latch bolt guard bolt 26 but also biases the retractor slide 5 toward the latch bolt extension slide 2 as best seen in FIGS. 6 and 8.

A latch fixing plate 32 is mounted on the inner surface of the end of the outer cylinder 21. This latch fixing plate 32 has a vertical opening 35 at its center. A lock protrusion 33 extends downward from the upper edge of the opening 35 while a step portion 34 is provided at a bottom side of the opening 35. The latch fixing plate 32 also has four fixing hooks 36, 36', 37 and 37'. Two fixing hooks 36 and 36' are integrally extended from upper and lower ends of the fixing plate 32 while the other fixing hooks 37 and 37' are provided on the opposed sides of the latch fixing plate 32 respectively. The upper and lower fixing hooks 36 and 36' of the fixing plate 32 are inserted in the rectangular opening 24 of the outer cylinder 21 at the upper and lower edges of the opening 24 while the opposed side fixing hooks 36 and 36' of the plate 32 are inserted in the elongated rectangular holes 18 and 18' of the outer cylinder 21 respectively. When the upper and lower fixing hooks 36 and 36' of the fixing plate 32 are received in the rectangular opening 24, they are punched at their ends so as to be bent outward, thus to tightly fix the latch fixing plate 32 to the end of the outer cylinder 21.

When assembling the aforementioned elements into the backset adjustable dead bolt assembly 50 of this invention, the rear sections of both the latch bolt extension slide 2 and the retractor slide 5 are received in the vertical opening 35 of the latch fixing plate 32. In this case, the pair of hooking protrusions 7*a* and 7*a'* of the retractor slide 5 are engaged with the upper lock protrusion 33 and the lower step portion 34 of the latch fixing plate 32 respectively. However, the rear section of the latch bolt extension slide 2 simply penetrates the vertical opening 35 of the latch fixing plate 32 with engagement of no protrusion thereof with the latch fixing plate 32. With the structure in that the hooking protrusions 7*a* and 7*a'* of the retractor slide 5 are engaged with the fixing plate 32 while the latch bolt extension slide 2 simply penetrates the fixing plate 32 at its rear section, the desired backset adjustment of the dead bolt assembly 50 between the 60 mm backset and the 70 mm backset are easily carried out.

In the drawings, the reference numeral 41 denotes the latch bolt stopping plate, the numeral 42 denotes a latch bolt biasing spring, the numeral 43 denotes a spring fixing pin fixed to a latch base board 17, the numeral 44 denotes a vertical opening of the latch base board 17 for receiving the rear sections of the slides 2 and 5, the numeral 51 denotes a plate spring mounted on the latch bolt stopping plate 41 and the numerals 57 and 58 are notches formed on the latch base board. Here, the upper notch 57 of the base board 17 receives the notched rear section of the latch bolt stopping plate 41 for fixing this stopping plate 41 thereto.

The above cylindrical door lock can be adjusted in its backset between the 60 mm backset and the 70 mm backset, thus to be commonly used in the conventional doors regardless of the door types. Hence, the above backset adjustable door lock does not confuse and trouble the users who want to change themselves their door locks but have no information about the backsets of the door locks to be changed.

Hereinbelow, the operational effect of the backset adjustable door lock of this invention will be described.

As described above, the door lock of this invention are characterized in that its backset can be easily adjusted between the 60 mm backset and the 70 mm backset and commonly used in the conventional doors regardless of the door types.

The backset adjusting device of this invention generally comprises three sections. The first section includes the axial cavity 4 of the latch bolt 1, which cavity 4 is enlarged for receiving therein the conventional latch bolt extension slide 2 and the retractor slide 5. At this time, the side guide projection 10 of the retractor slide 5 is movably received in the guide slot 6 of the latch bolt extension slide 2 such that it can be reciprocated forward and backward in the guide slot 6 within the range of 10 mm, thus to adjust the backset in the 10 mm distance.

The second section of the backset adjusting device of this invention includes the latch fixing plate 32. The rear sections of both the latch bolt extension slide 2 and the retractor slide 5 penetrate the vertical opening 35 of the latch fixing plate 32. Here, the backset adjustment of the dead bolt assembly 50 is achieved by causing only the pair of hooking protrusions 7*a* and 7*a*' formed on the rear section of the retractor slide 5 to be engaged with the vertical opening 35 of the fixing plate 32 but causing the rear section of the latch bolt extension slide 2 to simply pass through the opening 35. In order to achieve the above object, the upper lock protrusion 33 and the lower step portion 34 are provided on the opening 35. When adjusting the backset of the dead bolt assembly 50 to the 70 mm backset, the latch fixing plate 32 moves while trailing only the retractor slide 5 by 10 mm, thus to simply achieve the desired backset adjustment. The third section of the backset adjusting device comprises the inner and outer cylinders 11 and 21. Here, the inner and outer cylinders 11 and 21 not only let the operation of the first and second adjusting sections be precisely carried out but also protect the sections. In order to achieve the above objects, the inner cylinder 11 is provided with the guide hole 13 and the elastic lock piece 14 while the outer cylinder 21 is provided with the bent insert 22 at its front end and the pair of rectangular holes 23 and 23' on its outer wall. When assembling the inner and outer cylinders 11 and 21 into a cylinder assembly, the bent insert 22 of the outer cylinder 21 is bent radially inward so as to be inserted into the guide hole 13 of the inner cylinder 11. Hence, the elastic lock piece 14 of the inner cylinder 11 is naturally elastically snap into one of the rectangular holes 23 and 23' of the outer cylinder 21, thereby retaining the adjusted backset.

If briefly described, the inner and outer cylinders 11 and 21, the latch bolt extension slide 2, the retractor slide 5 and the latch fixing plate 32 cooperate with each other during a backset adjustment of the door lock.

Figure 5:
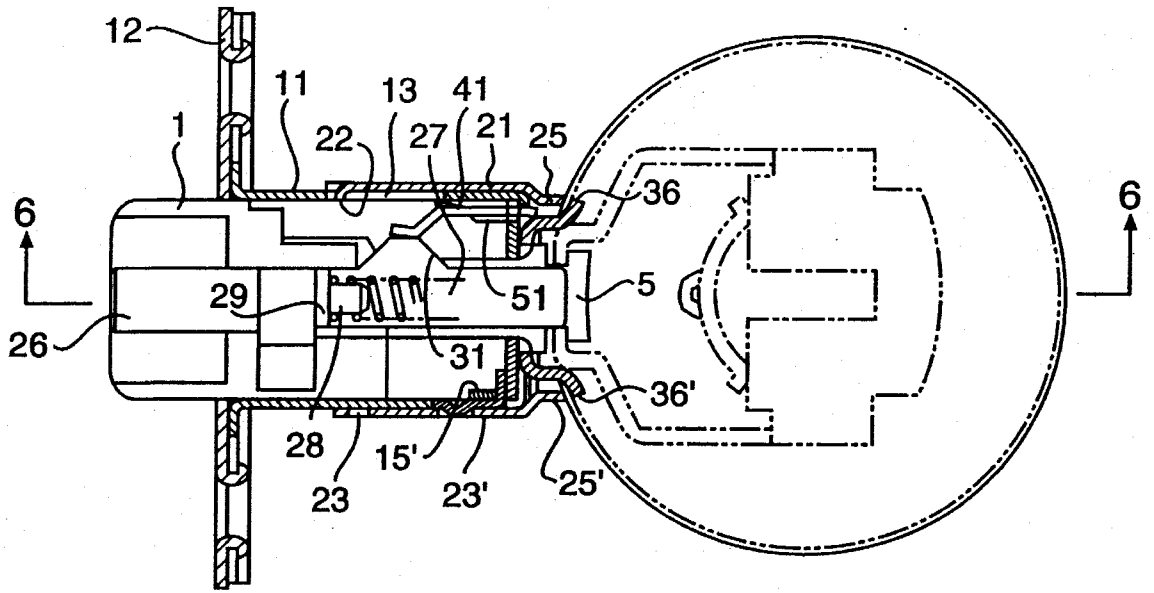
FIG. 5 is a sectional view of the cylindrical door lock having the backset adjusting device of this invention, when used as a 60 mm backset door lock.

The backset adjustment to 60 mm is achieved by elastic snapping of the elastic lock piece 14 of the inner cylinder 11 into the second rectangular hole 23' of the outer cylinder 21. At this time, the latch bolt extension slide 2 and the retractor slide 5 received in the cavity 4 of the latch bolt 1 coincide with each other as shown at the solid line of FIG. 4. In this state, the slides 2 and 5 are coupled to the cylinder knob housing, thus to provide the door lock adjusted to the 60 mm backset as shown in FIGS. 1, 5 and 6.

When adjusting the backset of the door lock from 60 mm to 70 mm, the outer cylinder 21 is pulled outward with respect to the dead bolt assembly 50 while pressing down the elastic lock piece 14 of the inner cylinder, which lock piece 14 has been received in the second rectangular hole 23' of the outer cylinder 21, using a sharp tool such as a driver or a gimlet. The elastic lock piece 14 of the inner cylinder 11 thus escapes out of the second hole 23' and, thereafter, elastically snaps into the first hole 23, thus to achieve the desired backset adjustment to 70 mm. During a backset adjustment to 60 mm or 70 mm, the bent insert 22 of the outer cylinder 21 inserted in the guide hole 13 of the inner cylinder 11 not only prevents a possible separation of the cylinders 11 and 21 from each other but also lets the outer cylinder 21 precisely move with respect to the inner cylinder 11. Hence, the outer cylinder 21 moves by a precise distance and reaches a precise position.

As described above, a backset adjusting device of a cylindrical door lock of the present invention free adjusts the backset of the door lock between the 60 mm backset and the 70 mm backset and lets the door lock be commonly used in the conventional doors regardless of the door types. This makes the users free from confusion and trouble when they want to change themselves their door locks but have no information about the backsets of the door locks to be changed. Since the backset adjusting device of this invention lets the door lock be commonly used in the two types of doors, it provides the users with an economical advantage.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A backset adjusting device of a cylindrical door lock comprising:

a latch bolt, said bolt having an enlarged cavity at its rear center;

a latch bolt extension slide received in said cavity of the latch bolt at its front section and coupled to said latch bolt by a fixing pin, said extension slide having an axial guide slot;

a retractor slide received in said cavity of the latch bolt at its front section in parallel with said latch bolt extension slide and movably coupled to said latch bolt extension slide so as to linearly reciprocate with respect to said extension slide by 10 mm, said retractor slide having:

an opened axial guide slit, said guide slit being formed on a front section of the retractor slide and receiving said fixing pin therein;

a side guide projection extending from a side surface of a middle section of the retractor slide toward the extension slide, said side guide projection being movably received in said guide slot of the extension slide in order to slide in said guide slot and to guide axial reciprocation of the retractor slide with respect to the extension slide; and a pair of hooking notches formed on a rear section of the retractor slide;

an inner cylinder axially receiving both said extension slide and said retractor slide such that rear sections of said slides protrude out of a rear end of said inner cylinder; and an outer cylinder movably fitted over a rear section of said inner cylinder and coupled to said hooking notches of the retractor slide at its rear end, said outer cylinder axially moving with respect to said inner cylinder while trailing said retractor slide, thus to adjust the backset of a dead bolt of said door lock between 60 mm backset and 70 mm backset.

2. The backset adjusting device according to claim 1, wherein said inner cylinder includes:

an axial guide hole, said guide hole being formed on a side wall of the inner cylinder; and an elastic lock piece formed by bending of a plate spring, said lock piece being provided on said side wall at a position backward spaced apart from said guide hole at an angular interval of 45°; and said outer cylinder includes:

a bent insert, said bent insert being formed on a front end of the outer cylinder and downward bent and movably inserted into said guide hole of the inner cylinder; and a pair of rectangular holes provided on a side wall of said outer cylinder at positions backward spaced apart from said bent insert at an angular interval of 45°, said rectangular holes being axially spaced out at 10 mm interval, one of said rectangular holes elastically receiving said elastic lock piece so as to retain an adjusted backset.

3. The backset adjusting device according to claim 1, further comprising a guard bolt extension slide for both supporting a latch guard bolt and biasing said retractor slide toward said latch bolt extension slide, said guard bolt extension slide being bent at right angle at its front section, thus to form a contact portion for supporting said latch guard bolt.

* * * * *